United States Patent [19]

Morris

[11] Patent Number: 4,955,419

[45] Date of Patent: Sep. 11, 1990

[54] FOLDABLE VALANCE

[75] Inventor: John F. Morris, Lake Mills, Wis.

[73] Assignee: Graber Industries, Inc., Middleton, Wis.

[21] Appl. No.: 410,839

[22] Filed: Sep. 22, 1989

[51] Int. Cl.[5] ..... E06B 9/00

[52] U.S. Cl. ..... 160/38; 160/178.1

[58] Field of Search ..... 160/38, 39, 19, 168.1, 160/176.1, 166.1, 178.1, 902; 16/225, DIG. 13; 5/493

[56] References Cited

U.S. PATENT DOCUMENTS 2,806,524 9/1957 Klenz ..... 160/38 X 3,574,887 4/1971 Schindlauer ..... 160/19 X 4,662,421 5/1987 Basmadji et al. ..... 160/38

4,828,002 5/1989 Ashby ..... 160/38

*Primary Examiner*—David M. Purol

*Attorney, Agent, or Firm*—Vernon J. Pillote

[57] ABSTRACT

A foldable valance having plastic hinges attaching the return panels to the front panel of the valance, to allow folding of the return panels alongside the front panel for compact packaging. A tab is formed integrally with one of the plate portions of the plastic hinge and is movable to a position extending at an angle to the associated plate portion of the hinge, for retaining the return panel in erected condition when the valance is installed.

8 Claims, 1 Drawing Sheet

Fig. 1.
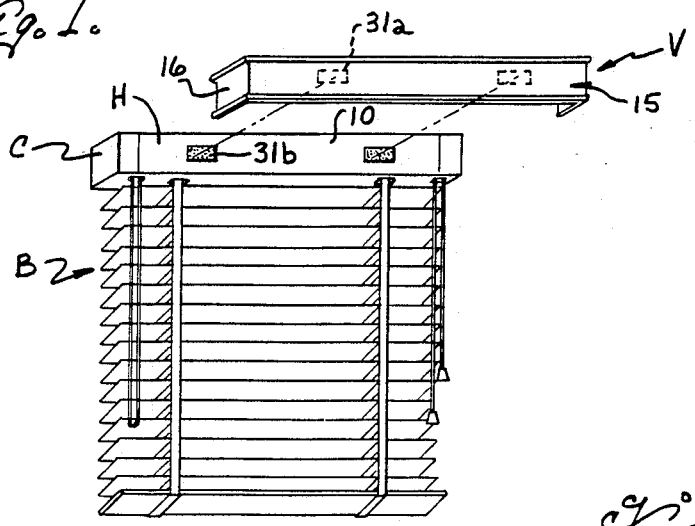
Fig. 2.
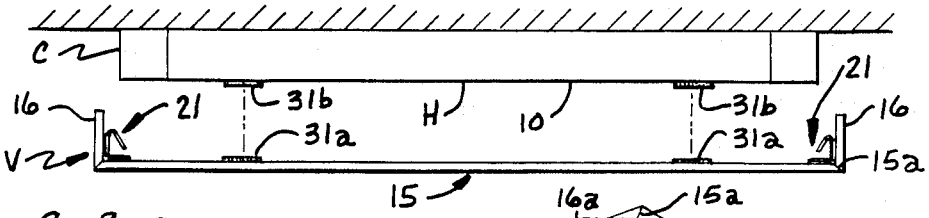
Fig. 3.
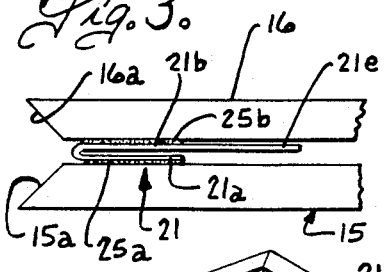
Fig. 4.
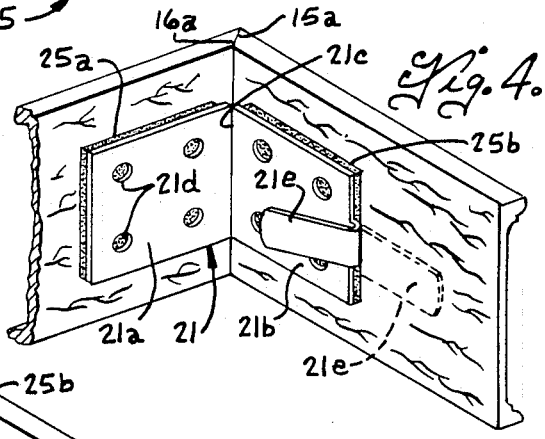
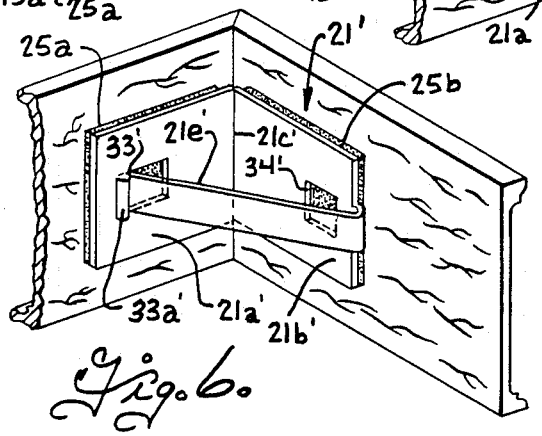
Fig. 6.
Fig. 5.
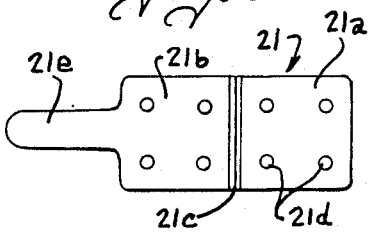

FOLDABLE VALANCE

BACKGROUND OF THE INVENTION

Foldable valances have heretofore been made having a front panel and return panels with mitered corners and with hinges connecting the return panels to the front panel to allow the return panels to be folded to positions alongside the rear of the front panel for compact packaging and to reduce breakage during storage and shipment. The hingedly connected return panels were adapted to be manually moved into an erected position extending perpendicular to the front panel when the valances were installed. However, the hingedly connected return panels could move out of perpendicularity with the front panel during or after installation and this problem was aggravated when plastic hinges were used. The plastic hinges would take a set once the return panels were folded in overlying relation to the front panels for packaging and such that the plastic hinges would not return toward their original flat conditions sufficient to move and hold the return panels in a fully erect position extending perpendicular to the front panel. This left an objectionable gap at the mitered corner between the return panels and the front panel.

SUMMARY OF THE INVENTION

It is an object of the present invention to overcome the problems encountered with the prior art foldable valances, by providing a foldable valance having an improved one-piece plastic hinge arranged to hingedly connect the return panels to the front panels of the valance to allow folding for compact storage, and which hinges are arranged to maintain the return panel in an erected condition when the valance is installed.

Accordingly, there is provided a foldable valance including a front panel and return panels connected to the ends of the front panel by one-piece plastic hinges to allow folding of the return panels to positions alongside the front panel for compact packaging during storage and transportation, and which the plastic hinges have a tab integral therewith and which is bendable to an operative position for retaining the return panels in an erected condition extending perpendicular to the front panel when the valance is installed. The tabs are advantageously arranged to engage the ends of a header for a blind or curtain, when the valance is installed.

BRIEF DESCRIPTION OF THE DRAWINGS

FIG. 1 is a perspective view illustrating assembly of the valance on a venetian blind header;

FIG. 2 is a top view illustrating assembly of the valance on a venetian blind header;

FIG. 3 is a fragmentary top view of the valance in a folded condition;

FIG. 4 is a fragmentary perspective view illustrating a return panel in an erected condition;

FIG. 5 is a plan view of a hinge in a normal flat condition; and

FIG. 6 is fragmentary perspective view illustrating the return panel in an erected condition and with a modified form of hinge.

DETAILED DESCRIPTION

Referring now more specifically to the accompanying drawings, there is disclosed a valance V for use with a header H for a horizontal or vertical blind designated generally by the numeral B. The header has a front wall

10 and end caps C at opposite ends, and the header is mounted on a supporting surface such as a wall or window casing either by securing the end caps thereto or by separate mounting brackets (not shown).

The valance V includes a front panel 15 and return panels 16 at opposite ends of the front panel. The front panel 15 has outer and inner faces and end edges 15*a* that are mitered or beveled at about 45°. The return panels 16 also have outer and inner faces and an end edge 16*a* that is mitered to abut the associated end 15*a* of the front panel to form a closed corner when the return panel is in an erected condition as shown in FIGS. 1, 2 and 4.

One-piece plastic hinges 21, formed of resilient plastic material such as polypropylene, are provided for hingedly connecting the return panels to the face panels to allow the return panels to be folded alongside the face panels as shown in FIG. 3, for compact packaging, storage and shipment of the valance. The hinges include first and second hinge plates 21*a* and 21*b* and an integral hinge portion 21*c* having a reduced thickness as compared to the plate portions, to facilitate bending of the plate portions relative to each other. The hinge is preferably molded with the plate portions 21*a* and 21*b* generally coplanar as shown in FIG. 5, and with the hinge portion 21*c* of reduced thickness formed by a relatively sharp groove or recess to provide a well defined hinge line between the plates. The hinge plates 21*a* and 21*b* are attached to the inner faces of the front and return panels at a location such that the flex line of the hinge is at the intersection of planes through the mitered ends 15*a* and 16*a* of the front and return panels and such that the mitered joint between the front and return panels is closed when the return panel is disposed substantially perpendicular to the front panel. The hinge plates may be attached to the front and end panels in any suitable manner, for example by pieces of double faced pressure sensitive adhesive tape designated 25*a* and 25*b*, or by adhesive or fasteners that extend through openings 21*d* in the plates.

The hinge portion 21*c* between the plate portions 21*a* and 21*b* of the plastic hinge will take a set when the return panel 16 is folded to extend alongside the rear of the front panel 15, for packaging, storage and shipment as shown in FIG. 3. When the return panel is thereafter manually moved to an erected position, the plastic hinge tends to move the return panel out of a fully erected position and such that there is a gap at the mitered corners between the front and return panels of the valance. In accordance with the present invention a tab 21*e* is formed integrally with one of the plate portions of the hinge and arranged so that it can be bent, at the time of installing the valance, to a position extending transverse to the associated plate portion to maintain the return panels in an erected condition. As best shown in FIG. 5, the tab 21*e* is molded integrally with the plate portion 21*b* at an edge thereof remote from the hinge portion 21*c*. The tab is initially disposed generally coplanar with the plate portion 21*b* and the tab can remain in this condition when the return panel is folded alongside the rear of the front panel as shown in FIG. 3. When installing the panels, the tab is adapted to be bent from its normal position shown in phantom in FIG. 4 to an operative position extending transverse to the hinge plate 21*b* as shown in solid lines in FIG. 4. The tab 21*e* is adapted to engage the end cap C or end brackets on the brackets on the header H, when the valance is installed, to yieldably press the end returns to their fully erected position.

Any suitable means may be provided for mounting the valance with the front and end panels of the valance extending along the front and ends of the header. In the embodiment illustrated, pads 31*a* and 31*b* of releasably interlocking hook and loop type fabric are attached to the rear face of the front panel and the front face of the header at locations to register with each other and hold the valance in position on the header. Alternatively, brackets can be provided for mounting the valance on the top of the header or on the supporting surface to which the header is attached. When installing the valance, the valance end panels are moved to their erected condition and the tabs are bent through somewhat more than 90° from their normal position as shown in FIGS. 2 and 4, so that the tabs are adapted to engage the end caps or brackets C when the valance is pressed rearwardly into position on the header and yieldably press the end panels to their fully erected condition.

A modified form of hinge is illustrated in FIG. 6 and like numerals are used to designate the same parts and like numerals followed by the postscript ′ are used to designate modified parts. In this embodiment, the hinge 21′ is formed with plate portions 21*a′* and 21*b′* that are connected along a reduced thickness hinge portion 21*c′*. A tab 21*e′* is formed integrally with one of the plate portions. The plate portions 21*a′*, 21*b′* and tab 21*e′* are initially molded in a flattened condition from a resilient plastic such as polypropylene. Plate portions 21*a′* and 21*b′* are attached to the inner faces of the front and end panels, in the manner previously described in connection with FIGS. 1–5.

In the embodiment of FIG. 6, the tab 21*e′* is formed on one of the plate portions 21*b′* and is bendable, during installation of the valance, to a position extending diagonally between the plate portions with the distal end of the tab engaging a shoulder or keeper 33′ on the other plate portion 21*a′*, to maintain the return panel in an erected condition. The keeper 33′ may, as shown in FIG. 6, comprise an opening in the panel 21*a′* that defines a shoulder for engaging the distal end of the tab or a rib 33*a′* on the rear of the plate portion, or both. When a rib such as 33*a′* is used, the other plate portion is advantageously formed with an opening 34′ at a location to receive the rib when the return panel is folded on the front panel. The tab 21*e′* is resilient so that it can deflect if it engages a corner of the header end cap when the valance is pressed rearwardly onto the header in the manner shown in FIG. 1.

From the foregoing it is believed that the construction and use of the foldable valance will be readily understood. The hinge including the plate portions and tab can be economically molded in one piece in a generally flattened condition. When the plate portions of the hinge are attached to the front and return panels of the valance, the return panels can be folded to a position alongside the front panels as shown in FIG. 3 for compact packaging during storage and transportation. During installation, the return panels are moved to an erected condition and the tabs bent to a position extending transverse to the associated hinge plate, to engage the end cap or brackets C on the header as shown in the embodiment of FIGS. 1–5 or to engage a keeper on the other hinge plate as shown in FIG. 6. The tabs are adapted to be bent through somewhat more than 90° from their normal position to extend from the associated hinge plate at an acute angle toward the other hinge plate and such that the tabs can cam over the end caps on the header when the valance is pressed rearwardly into position on the header. The tabs then yieldably hold the return panel in a fully erected condition, and with the miter joint between the front and return panels closed. In the embodiment of FIG. 6, the tabs on one end plate of the hinge are arranged to engage a keeper on the other end plate to hold the return panels of the valance in an erected condition.

The embodiments of the invention in which an exclusive property or privilege is claimed are defined as follows:

1. A foldable valance for a headrail having a front and ends, the valance including an elongated front panel and at least one return panel, the front panel and return panels each having an inner and an outer side face and end faces adapted to abut when the inner side face of the return panel extends generally perpendicular to the inner side face of the front panel, a one-piece hinge formed of flexible plastic and including first and second plate portions and an integral hinge portion flexibly connecting the first and second plate portions, means attaching the first plate portion to the inner side face of the front panel and means attaching the second plate portion to the inner side face of the return panel to hingedly connect the front and return panels for movement between a folded position in which the inner side face of the return panel extends alongside the inner side face of the front panel and an erected position in which the inner side face of the return panel extends transverse to the inner side face of the front panel, the one-piece hinge including a tab integral with the second plate portion of the hinge and bendable from a normal position disposed generally in the plane of the second plate portion to a position extending transverse to the second plate portion for retaining the return panel in the erected position with the end faces of the front and return panels in abutting relation.

2. A foldable valance according to claim 1 including means for mounting the valance with the front and return panels respectively overlying the front and end of the headrail, the tab being arranged to engage an end of the headrail when the valance is mounted to retain the return panel in the erected position.

3. A foldable valance according to claim 1 including means for mounting the valance with the front and return panels respectively overlying the front and end of the headrail, the tab being integrally joined with the second plate portion at a location spaced from the hinge portion and such that the tab can be flexed from its normal position to a position extending toward the first plate portion at acute included angle relative to the second plate portion for engagement with an end of the headrail.

4. A foldable valance according to claim 1 including means on the first plate portion for engaging and retaining the tab in a position extending between the first and second plate portions to retain the return panel in an erected position.

5. A foldable valance according to claim 1 wherein the tab is integrally joined with the second plate portion at a location spaced from the hinge portion and such that the tab can be flexed from its normal position to an operative position extending toward the first plate portion at an acute angle relative to the second plate portion.

6. A foldable valance according to claim 5 including means on the first plate portion for engaging and retaining the tab in said operative position.

7. A foldable valance for a headrail having a front and ends, the valance including an elongated front panel and at least one return panel, the front panel and return panel each having an inner and an outer side face and end faces adapted to abut when the inner side face of the return panel extends generally perpendicular to the inner side face of the front panel, a onepiece hinge formed of flexible plastic and including first and second hinge portions and an integral hinge portion flexibly connecting the first and second plate portions, means attaching the first plate portion to the inner side face of the front panel and means attaching the second plate portion to the inner side face of the return panel to hingedly connect the front and return panels for movement between a folded position in which the inner side face of the return panel extends alongside the inner side face of the front panel and an erected position in which the inner side face of the return panel extends transverse to the inner side face of the front panel, the onepiece hinge including a tab integral with one of the plate portions of the hinge and bendable from a normal position disposed generally in the plane of said one plate portion, to an operative position extending from said one plate portion into engagement with the other of the plate portions to retain the panels in the erected position with the end faces of the front and return panels in abutting relation.

8. A foldable valance according to claim 7 including keeper means on the other of the plate portions engageable with the tab for retaining the tab in said operative positions.

* * * * *

UNITED STATES PATENT AND TRADEMARK OFFICE

CERTIFICATE OF CORRECTION

PATENT NO. : 4,955,419

DATED : September 11, 1990

INVENTOR(S) : John F. Morris

It is certified that error appears in the above-identified patent and that said Letters Patent is hereby corrected as shown below:

ON TITLE PAGE:

Change the name of the inventor from "John F. Morris" to -- John E. Morris --.

Column 5, line 10, change "onepiece" to -- one-piece --;

line 12, change "hinge" (first occurrence) to -- plate --;

Column 6, line 4, change "onepiece" to -- one-piece --.

Signed and Sealed this

Twenty-fifth Day of February, 1992

*Attest:*

HARRY F. MANBECK, JR.

*Attesting Officer*

*Commissioner of Patents and Trademarks*